United States Patent [19]

McKelvy

[11] Patent Number: 4,632,604

[45] Date of Patent: Dec. 30, 1986

[54] FROZEN ISLAND AND METHOD OF MAKING THE SAME

[75] Inventor: Andy M. McKelvy, Danville, Calif.

[73] Assignee: Bechtel International Corporation, San Francisco, Calif.

[21] Appl. No.: 638,792

[22] Filed: Aug. 8, 1984

[51] Int. Cl.[4] ..... E02D 21/00; E02D 23/16

[52] U.S. Cl. ..... 405/217; 405/130; 165/45; 62/260

[58] Field of Search ..... 405/11, 14, 61, 130, 405/195, 203–205, 207, 217; 62/259.1, 260; 165/45

[56] References Cited

U.S. PATENT DOCUMENTS

| | | | |
|---|---|---|---|
| 3,783,627 | 1/1974 | Blurton et al. | 405/217 |
| 3,798,912 | 3/1974 | Best et al. | 405/61 |
| 3,952,527 | 4/1976 | Vinieratos et al. | 405/217 |
| 3,990,253 | 11/1976 | Lea | 405/217 |
| 4,055,052 | 10/1977 | Metge | 405/217 |
| 4,094,149 | 6/1978 | Thompson et al. | 405/217 X |
| 4,118,941 | 10/1978 | Bruce et al. | 405/207 X |
| 4,187,039 | 2/1980 | Jahns et al. | 405/217 |
| 4,446,256 | 8/1984 | MacCracken | 62/260 |
| 4,486,125 | 12/1984 | Reusswig | 405/217 |

FOREIGN PATENT DOCUMENTS

| | | | |
|---|---|---|---|
| 1603517 | 11/1981 | United Kingdom | 405/217 |

*Primary Examiner*—Richard J. Scanlan, Jr.
*Assistant Examiner*—Nancy J. Stodola
*Attorney, Agent, or Firm*—Townsend and Townsend

[57] ABSTRACT

An island adapted to be put into place in arctic regions in a body of water having a soil layer below water level and above a permafrost line. In one form of the island, an island body is placed on the soil layer, the island body comprising a number of vertically stacked layers of freezable material, the bottom of each layer having a freeze panel adjacent thereto in heat exchange relationship therewith. A coolant flowing through the panels causes the soil layer and the freezable layers to freeze, the coolant source being on the island body at any suitable location. The island body surrounds a recess which also contains several layers of freezable material separated by freeze panels adapted to receive a coolant for flow in heat exchange relationship to the freezable layers. By freezing the freezable layers, the island body is provided with a monolithic construction and the island body is bonded to the soil layer. In another form of the island, a caisson is floated to a location above a dredged-out area in the soil layer and then lowered into place. The caisson is adjacent to the soil layer and separated by a space which is filled with fresh water which can be frozen when a coolant flows through an adjacent freeze panel in heat exchange relationship to the fresh water. Alternately, the caisson is supported on a number of layers of freezable material with each layer being separated by a freeze panel having means for directing a coolant in heat exchange relationship to the freezable layer. If it is desired to separate the caisson from the frozen soil layer, warm fluid is directed in heat exchange relationship to the soil layer to break the bond between the caisson and the soil layer, whereupon the caisson can be rendered buoyant and floated away to a new site.

63 Claims, 9 Drawing Figures

FROZEN ISLAND AND METHOD OF MAKING THE SAME

This invention relates to improvements in the formation of man-made islands and, more particularly, to a frozen island in arctic climates.

BACKGROUND OF THE INVENTION

In the past, soils have been frozen in arctic regions by the use of freeze piles to stabilize weak soils in the vicinity of tunnels and dams. Also, thermal siphon piles have been used to maintain permafrost under buildings and pipelines. However, existing soil freezing techniques have not been used to form man-made islands and, because of the frequent use of platforms for oil drilling and other activities in arctic regions, a need has existed for man-made islands and methods for constructing such islands. The present invention satisfies this need.

SUMMARY OF THE INVENTION

The present invention is directed to an island which is made-made and suitable for use in arctic zones in a body of water overlying a soil layer above a permafrost line or suitable foundation soil. The aim of the present invention is to provide a strong, stabilized, monolithic island body where none existed before. After construction of the island, it can be used as a permanent installation inasmuch as the island is frozen substantially throughout its extent and mechanically bonded to the soil layer therebelow.

In a first embodiment, the island has a body comprised of a number of vertically spaced, horizontal freeze panels, the lower panel being on a soil layer above the permafrost line or suitable foundation soil. A layer of freezable material, such as gravel or sand fill material, is placed on each freeze panel, respectively. Each freeze panel has fluid flow passages therethrough to receive a coolant which moves in heat exchange relationship to the adjacent soil layer or layer of freezable material, the source of the coolant being at any suitable location, such as on the top of the island body, with fluid flow lines extending between the source and the fluid passages of the freeze panels. By directing a coolant through the passages, the soil layer and the freezable layers can be frozen to form a monolithic construction for the island body.

In the foregoing embodiment, the island body is formed with a generally continuous outer surface or bank and surrounding a central recess. This recess is provided with vertically spaced freeze panels and a layer of freezable material, such as silty sand material, on each freeze panel in the central recess. The upper surface of the uppermost freezable layer in the central portion is generally co-extensive with the upper surface of the island body to present the top surface of the island on which equipment and other structures can be mounted. The freeze panels in the central recess are provided with a flow of coolant to freeze the adjacent portions of the soil layer and the freezable layers in the central recess, the source of the coolant being the same source as the coolant source for the island body or a different source, if desired.

Another embodiment of the present invention comprises a caisson which can be made at a remote location and floated on a body of water to a location at which an island is to be made. The caisson can be lowered into a dredged-out hole onto a soil layer therebelow. In relatively shallow waters, the caisson can have a freeze panel on the bottom thereof which can be moved into proximity with and spaced from the upper surface of the adjacent soil layer to form a space between the bottom and the permafrost layer. Fresh water can be directed into this space and frozen by directing a coolant in heat exchange relationship to the water layer. In this way, the caisson becomes bonded to the adjacent permafrost layer.

To use the caisson in deeper waters, the soil layer is dredged out and a number of vertically spaced freeze panels are put on the soil layer, each pair of freeze panels being separated by a layer of freezable material to present a base on which the caisson can be lowered. By directing a coolant through each freeze panel, the soil layer and the layers of freezable material can be frozen, either before or after the caisson is put into place, all of which allows the caisson to present a man-made island with a rigid foundation or a base. The caisson can be simply moved by directing a warm fluid through the coolant passages to break the bond between the caisson and its base, whereupon the caisson can be floated to another site.

The primary object of the present invention is to provide an improved man-made island in arctic climates and a method of making the island wherein the island can be formed on a soil layer adjacent to a permafrost or suitable foundation material line below water level in a manner such that the island is formed of one or more layers of freezable material which, when frozen, are rigid and present a good mechanical bond between the island and the soil layer therebelow, all of which contributes to the structural integrity of the island so that it presents a monolithic structure suitable for a number of different applications.

Other objects of this invention will become apparent as the following specification progresses, reference being had to the accompanying drawings for an illustration of several embodiments of the invention.

IN THE DRAWINGS

Figure 1:
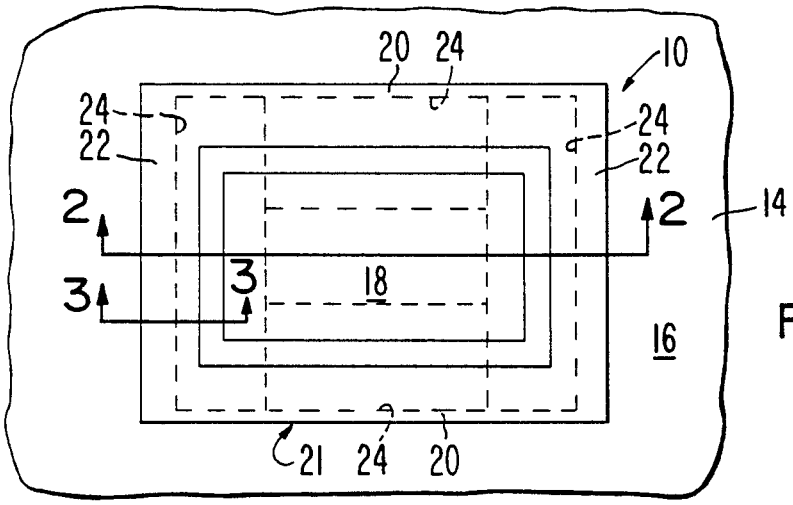
FIG. 1 is a top plan view of a frozen island of the present invention.

A first embodiment of the frozen island of the present invention is broadly noted by the numeral 10 and is shown in plan form in FIG. 1. Island 10 is mounted in place above the permafrost or suitable foundation soil line 12 below the water level 14 of a body of water 16.

A typical configuration of the island is a square or rectangular configuration 1000 feet on a side. However, the island could be of any other configuration and can generally be of any other dimensions.

Island 10 has a central, generally flat, horizontal upper surface 18 defining the top of a central portion 19 of island 10. Portion 19 is surrounded by an outer peripheral support 21 comprised of a pair of generally parallel sides 20 and a pair of generally parallel ends 22, ends 22 being integral with sides 20 as shown in FIG. 1. One end of support 21 is shown in detail in FIG. 3 and is the same in construction as both sides 20 and the other end 22. Thus, a description of end 22 as shown in FIG. 3 will suffice for sides 20 and the other end 22.

Figure 3:
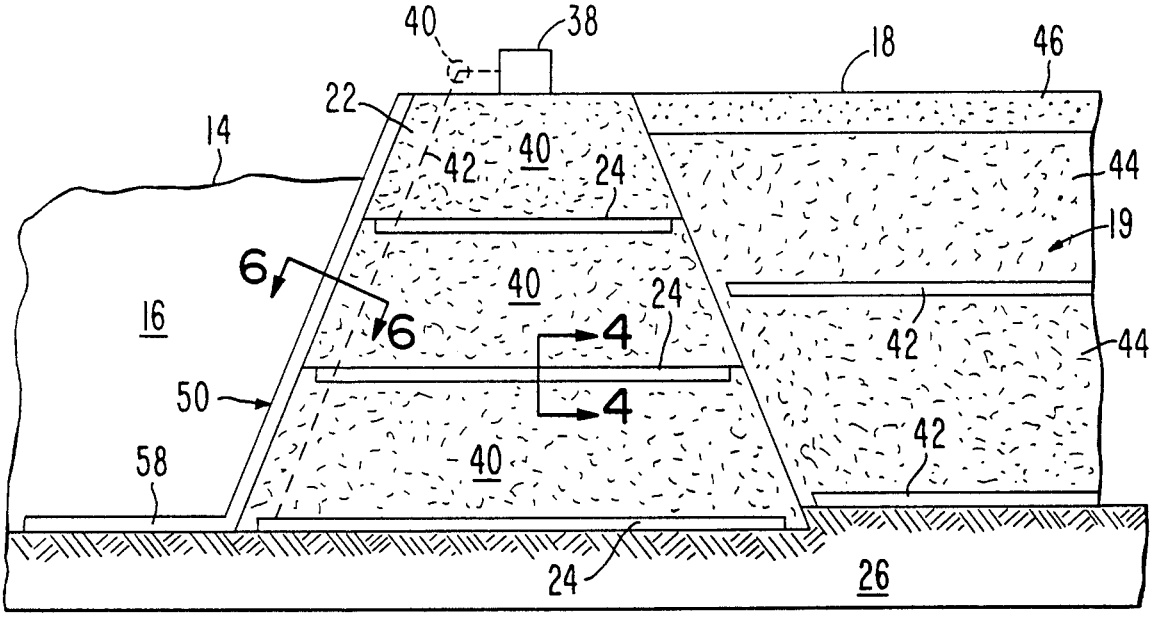
FIG. 3 is an enlarged, fragmentary, cross-sectional view taken along line 3—3 of FIG. 1 showing the arrangement of the freeze panels in the island.

End 22 includes a number of vertically spaced, generally horizontal freeze panels 24, only three of which are shown in FIG. 3. The bottom freeze panel 24 rests on a layer 26 of existing soil which has a predetermined thickness, such as 10 feet, above the permafrost or suitable foundation soil line 12. Dredging of the soil down to the predetermined level at which the bottom freeze panel 24 is placed is done at the beginning of the process of forming island 10.

Each freeze panel at a given level in support 21 is smaller in width than the freeze panel adjacent to and below it. Thus, as shown in FIG. 3, the middle and upper freeze panels 24 are smaller in width than the bottom freeze panel 24, and the upper freeze panel 24 is smaller in width than the middle freeze panel. However, as shown in dashed lines in FIG. 1, the freeze panels of 24 are generally of the same length as they extend longitudinally of the corresponding side 20 or of the corresponding end 22. For purposes of illustration, the freeze panels 24 of ends 22 are longer than the freeze panels 24 of sides 20. It is sufficient that the freeze panels 24 at a given level in support 21 are substantially end to end to effectively cover a given area determined by the widths and lengths of the freeze panels.

Figure 4:
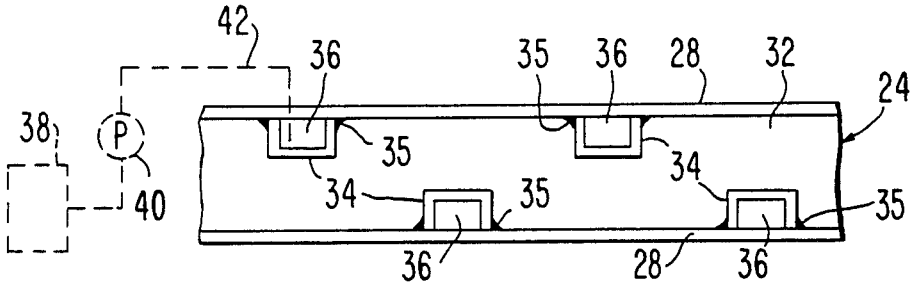
FIG. 4 is an enlarged, cross-sectional view taken along line 4—4 of FIG. 3.

Each freeze panel has a cross-section as shown in FIG. 4. To this end, each freeze panel 24 includes a pair of spaced plates 28 of heat conducting material, such as a suitable steel, there being a layer 32 of insulating material, such as a suitable polyurethane material, which is foamed in place between plates 28. Each plate 28 has a plurality of U-shaped members 34 secured thereto, such as by welding, or caulking with polyurethane sealant, each member 34 being sealed to the corresponding plate 28 by sealing means 35. Also, each member 34 defines a fluid passage 36 for the flow of a coolant, such as a water-glycol mixture, therethrough. The coolant emanates from a source 38 by way of a pump 40 and moves along a fluid line 42. Source 38 can be on top of island 10 as shown in FIG. 3.

The various fluid passages 36 can be coupled to source 38 in any suitable manner so long as a flow of the coolant is made through all passages 36. The members 34 have a U-shaped configuration to allow the coolant to be movable in direct contact with and thereby in heat exchange relationship to the adjacent plate 28. Thus, by directing the coolant through passages 36, control of the temperature of the surrounding soil layer in contact with the plates 28 can be achieved to thereby cause the lowering of the temperature of the soil to provide island 10 with a firm, strong, stabilized monolithic construction.

Above each freeze panel 24 is a layer 40 of gravel fill material. Typically, the depth of each of the lower gravel layers 40 is about 20 feet. A typical depth for the upper gravel layer 40 is about 20 feet. The gravel layers 40 are successively put into place, beginning with the lower layer 40 which is put into place immediately after the bottom freeze panel 24 is put into place. After the lower gravel layer 40 is put into place, the middle freeze panel 24 is placed on the upper surface of the lower gravel layer 40. Then the next gravel layer is placed on top of that freeze panel and so on until support 21 is constructed.

The entire extent of support 21, including both sides 20 and both ends 22 are constructed in the manner described above with respect to the building of end 22 with reference to FIG. 3. Support 21 is completed before work on the central portion 19 of island 10 is commenced.

The central portion 19 of island 10 includes a number of vertically spaced freeze panels 42, only two of which are shown in FIG. 3. The freeze panels increase in width as the upper end of the central portion of the island is approached. Each freeze panel 42 has the same construction as each freeze panel 24 (FIG. 4), and the lowermost freeze panel 42 rests on an upper surface of layer 26 several feet above the level at which the lowermost freeze panel 24 is located. The source of the coolant for flow through the fluid passages in freeze panels 42 typically is the same source 38 which provides the coolant supply for the fluid passages of freeze panels 24. However, it may be a separate source, if desired.

A layer 44 of silty sand is located above each freeze panel 42, respectively. Such silty sand is dredged from soil layer 26. A gravel layer 46, typically of 5-foot thickness, is placed on the upper sand layer 44. The upper surface of the gravel layer 46 is flattened and rendered generally horizontal to present the upper surface 18 of island 10.

To construct island 10, a suitable location in the North Slope arctic region is selected where the permafrost or suitable soil is typically no greater than 60 feet in depth below the proposed upper surface 18 of the island to be built. The first step in constructing the island, is to dredge the area of the island to within a certain distance, such as 10 feet, of the permafrost or suitable foundation soil line 12. This 10-foot distance is within a one-year freeze depth of the permafrost. The entire bottom area to be covered by the island is dredged, and support 21 is constructed before the central portion 19 of the island is constructed.

The first step in building island 20 after the dredging operation is to place the bottom freeze panels 24 of support 21 on the upper surface of layer 26. After the bottom freeze panels 24 have been put in place, the first layers 40 of gravel fill are placed on respective bottom freeze panels 24, and each gravel fill layer will be of a predetermined depth such as 20 feet. After placement of each bottom layer 40 on the corresponding bottom freeze panel 24, the next or middle freeze panels 24 are placed on the upper levels of the lower gravel fill layers 40, following which the second layers 40 of gravel fill material are placed on the middle freeze panels 24. Then, the upper freeze panels are placed on the upper surfaces of the middle gravel layers, following which the upper gravel layers 40 are placed on the upper freeze panels 24 to complete support 21. When completed, support 21 has a pyramid-shaped cross-section for each of sides 20 and each of ends 22. The thickness of the middle gravel layer 40 is approximately 20 feet and the thickness of the upper gravel layer is approximately 10 feet. The height of each side 20 and each end 22 is, therefore, approximately 50 feet, with each bottom freeze panel 24 being about 10 feet above the permafrost line 12.

Figure 2:
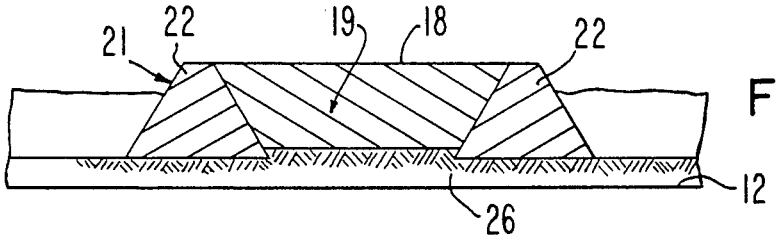
FIG. 2 is a cross-sectional view of the island taken along line 2—2 of FIG. 1.

After support 21 is completed, work on the center portion 19 of island 10 is commenced. The first step is to lay the bottom freeze panel 42 in place. This can be done at the same time the bottom freeze panels 24 are put into place or after completion of support 21. The next step is to apply a layer 44 of sandy silt material on the bottom freeze panel 42. This sandy layer 44 is dredged from the existing soil which is in soil layer 26. Typically, the thickness of bottom sand layer 44 is 28 feet. Then, the next freeze panel 42 is placed on the bottom layer 44, following which a second silty sand layer 44 is placed on the upper freeze panel 42, the thickness of the second layer 44 being typically 14 feet. Finally, a layer 46 of gravel fill material is placed on second layer 44, the thickness of layer 46 being typically 5 feet. The purpose of layer 46 is to control the active frost depth. The upper surface of layer 46 is upper surface 18 which is co-extensive with the upper surface of support 21 as shown in FIGS. 2 and 3. Insulated, armored freeze panels 50 are placed on outer banks of body 21 as hereinafter described.

After island 10 is constructed, a coolant is caused to flow through the fluid passages of the various freeze panels 24, 42 and 50 and causes, by heat exchange relationship, a reduction in the temperature of the adjacent layers of soil, gravel or sand. This causes such layers to effectively freeze and remain frozen to form a strong, stabilized monolithic construction for the island which becomes permanent in place and stabilized by the permafrost once the initial freezing is accomplished. The resulting structure will then present a foundation which is substantially the same as that found on land with no settlement.

Figure 5:
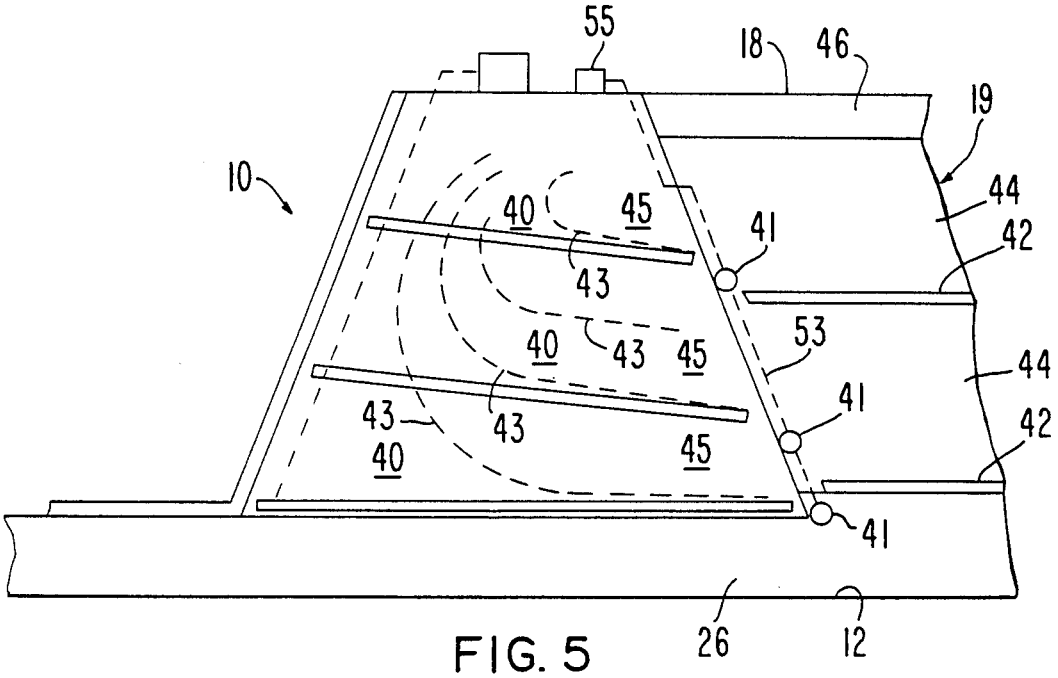
FIG. 5 is a view similar to FIG. 3 but showing another embodiment of the island with certain of the freeze panels thereof in inclined positions.

A slight modification of island 10 can be made in which the freeze panels 24 are tilted as shown in FIG. 5 or the top freezing surface is effectively tilted by freezing faster on one side than the other or by freezing faster at the center portions than at the side portions. In any case the tilting creates a sloped freezing surface to cause a hydraulic gradient for the heavily concentrated sea water to escape to drains at the bottoms of the slopes.

In FIG. 5, the tilt is such that the lower edge of each freeze panel 24 is near the central portion 19 of the island. Thus, the salty water in the layers 40 will eventually gravitate toward the central portion 19 of the island and porous pipes 41 can be strategically located in central portion 19 near the lower margins of freeze panels 24 to extract this highly concentrated salty water and such water can be pumped over a fluid line 53 by a pump to a collection tank 55 on the surface or discharged to the sea at some distance. In this way, the extremely salty water is eliminated from layers 40 and will not present a stability problem because such salty water is extremely difficult if not impossible to freeze into a solid mass.

The curved, dashed lines denoted by the numerals 43 indicate the directions in which the salty water gravitates by virtue of the inclination of freeze panels 24 or sloped freezing surface. The water tends to gravitate to the locations identified by the numeral 45 below each freeze panel 24, and it is at these locations that the pipes 41 are located to receive and allowal removal of the salty water to avoid having the salty water remain in the layers 40.

In the case where the freeze panels are designed to freeze faster either at one side or at the center, the freeze panels have a greater concentration of fluid passages 36 either at the one side or the center. Thus, the freezing capacity at the one side or the center is greater than at other locations on a freeze panel.

Figure 6:
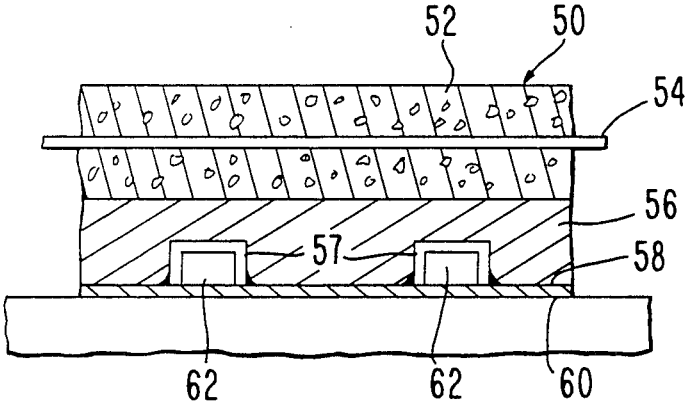
FIG. 6 is a cross-sectional view taken along line 6—6 of FIG. 3.

FIGS. 3 and 6 show how the outer banks of island 10 which face the water 16 are stabilized. To this end, each of the outer banks of support 21 is comprised of a panel 50 which extends from the top of the island to the upper surface or layer 26 below the water level 14.

Panel 50 is comprised of a layer 52 of concrete which is reinforced by rods 54 extending through layer 52. A layer 56 of insulating material, such as polyurethane or the like, is bonded in any suitable manner, such as by foaming in place, to the concrete layer 52. The insulating layer 56 has a plurality of U-shaped channel members 57 embedded therein and secured to the upper surface 58 of a heat conducting, metallic plate 60 of suitable material, such as steel or the like. Members 57 define fluid passages 62 which are in heat exchange relationship with the surface 58 of plate 60. Thus, a coolant flowing through passages 62 will be in direct contact with and in heat exchange relationship to plate 62 to thereby assist in freezing the gravel layer 40 adjacent to and below panel 50. Panel 50 extends along the outside inclined face of the bank and then extends horizontally to present an extension 58 shown in FIG. 3. The concrete panel 50 extends about the entire outer periphery of island 10. The coolant can be pumped through passages 62 from source 38 as indicated by dashed lines in FIG. 3 or from any other source.

Panel 50 will also maintain a permanent freeze bond between the soil and plate 60 during winter and spring breakup. It will provide a shear range of 100 psi. The concrete surface of layer 52 is troweled with a hard finish and coated with epoxy paint or some ice adhesion breaker.

Figure 7:
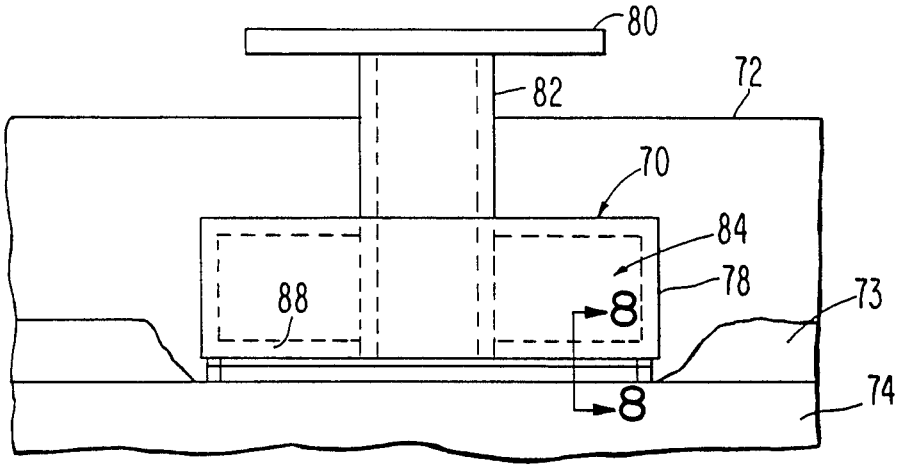
FIG. 7 is a side elevational view of a movable caisson in place in a dredged-out hole above the permafrost line, the caisson defining a movable island.
Figure 8:
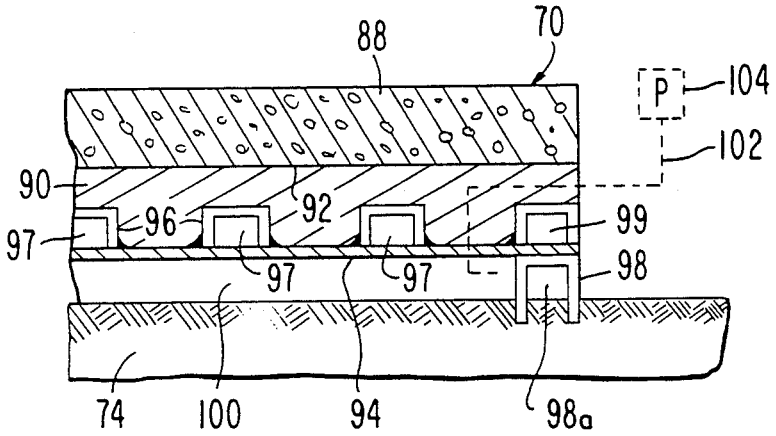
FIG. 8 is an enlarged, fragmentary cross-sectional view taken along line 8—8 of FIG. 7.

FIGS. 7 and 8 show a movable caisson 70 which can be floated over the water surface 72 and lowered into a dredged-out hole to the permafrost or frozen foundation line 74. The caisson is provided with a lower part 78 which is generally circular in configuration, an upper platform 80, and a rigid pillar 82 for supporting the platform 80 on lower part 78. The interior 84 of lower part 78 is hollow so that it can contain pumping mud and other equipment or to increase or decrease the buoyancy of the caisson with water. Thus, the caisson can be made at a location on land and floated on the water to the point of use, whereupon it can be filled with water to decrease its buoyancy to cause it to sink into place on soil layer 76.

The caisson is formed from concrete or steel and has a bottom 88 to which an insulating layer 90 (FIG. 8) is bonded, such as by a suitable adhesive or foamed in place urethane at the interface 92 between concrete bottom 88 and layer 90. The insulating material of layer 90 typically is polyurethane, but it can be of other material, if desired.

A heat conducting plate 94 is secured to the bottom of insulating layer 90, and a plurality of inverted U-shaped channel members 96 are secured such as by welding or caulking with polyurethane sealant or the like to the upper surface of plate 94. The plate is provided at its outer periphery with U-shaped channel members 98 which are driven into the permafrost when caisson 70 is lowered into place in the dredged-out hole above permafrost or frozen soil layer 76. The lower margins of channel members 98 sink partially into permafrost or frozen soil layer 76 to form space 98*a*. This space 98*a* is pumped out and refilled with fresh water which is frozen to permafrost. This seals and supports the outer peripheral edge of the caisson. Space 100 initially is filled with salt water. The salt water is pumped out of space 100 along a fluid line 102 by a pump 104 which typically is carried on platform 80 of the caisson 70. After the salt water is pumped out of space 100, fresh water can be pumped into the space so that water will fill the space and will bridge the gap between the upper surface of permafrost or frozen soil layer 76 and the bottom surface of heat conducting plate 94.

By directing a coolant through the fluid passages 97 defined by members 96, the water in space 100 can be frozen and bonded both to the bottom of plate 94 and to the top surface of permafrost or frozen soil layer 76. This interconnects the permafrost or frozen soil layer and the caisson, thereby rendering the caisson permanently stabilized and connected to the permafrost so long as ice remains in space 100.

The operation of placing the caisson in position commences with the movement of the caisson over the water to the point of use after the dredging of the bottom has been accomplished, such dredging being done to permafrost or frozen soil level 74. Then, the caisson is lowered into place, presenting space 100 inasmuch as channel members 98 define outer peripheral seals for the space 100. Salt water is then pumped out of space 98*a* and fresh water is pumped into the space, following which coolant is directed through passages 97*a* defined by U-shaped members 99, the coolant being in direct contact and thereby heat exchange relationship with heat conducting plate 94 which freezes the water in space 98*a*. The frozen water, in turn, freezes and is bonded to the permafrost or frozen soil layer below space 98*a*. Salt water in space 100 is displaced with fresh water which is frozen by freeze panels, thus bonding the caisson to the frozen soil.

If it is desired to move the caisson once it has been put into place, the bond between the caisson and the frozen soil is broken by directing a warm fluid, such as water, through passages 97, thereby melting ice in spaces 98*a* and 100, allowing the caisson to be floated upwardly and away from the frozen soil layer and moved to the new job site. At the new site, the caisson is lowered into place and permanently secured to the frozen soil layer in a dredged-out hole as described above with respect to FIGS. 7 and 8.

Figure 9:
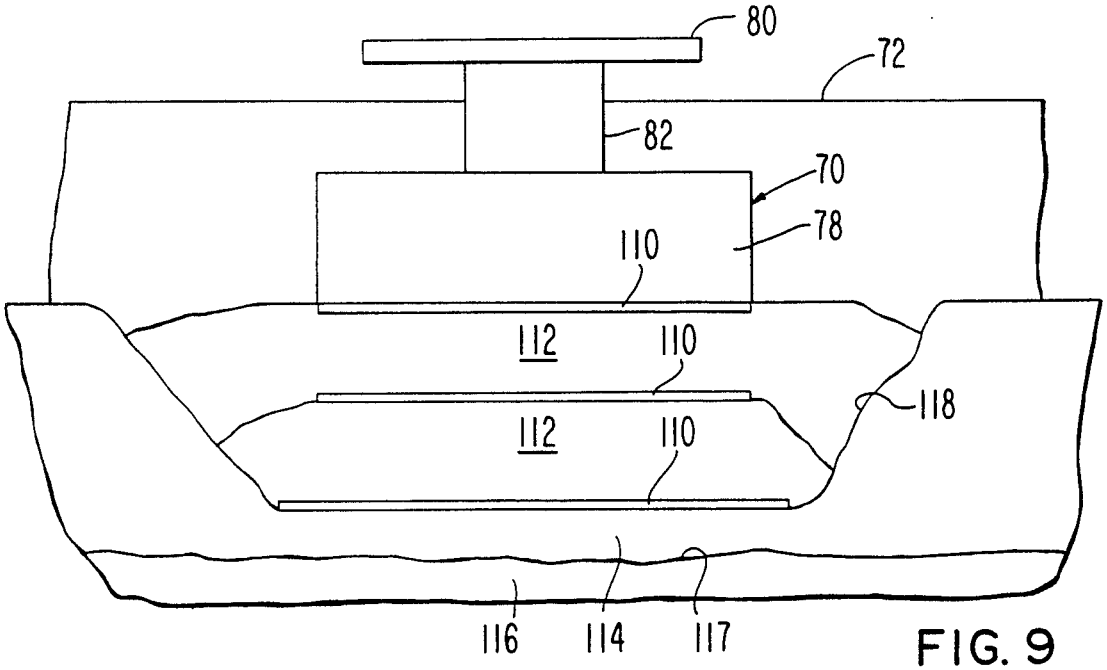
FIG. 9 is a view similar to FIG. 7 but showing another way in which the caisson can be mounted in place above the permafrost or suitable foundation soil.

The embodiment described in FIGS. 7 and 8 is typically used for permafrost depths of approximately 50 to 120 feet below water level 72. However, in deeper waters, such as those over 120 feet between the permafrost layer and the water surface 72, the arrangement of FIG. 9 may be used. In this arrangement, caisson 70 is supported above freeze panels 110 which are separated by dredged-in soil layers 112 such that the upper freeze panel 110 is supported on the upper of the two soil layers 112. The lower freeze panel 110 is situated on a soil layer 114 directly above the permafrost layer 116. The dredging hole is defined by the outer boundary 118 (FIG. 9). Typically, the distance between upper water level surface 72 and the upper freeze panel 110 is approximately 60 feet, and the distance between the upper freeze panel 110 and the permafrost upper surface 117 is about 60 feet.

The procedure in using the arrangement of FIG. 9 is to first dredge out the hole into which the freeze panels 110 are to be placed. Then the next step is to place the bottom freeze panel 110 on soil layer 114. The lower soil layer 112 is then dredged into place, following which the next or middle freeze panel 110 is placed on the lower soil layer 112. Then, the next soil layer 112 is dredged into place and the caisson, having the upper freeze panel 110 attached thereto, is lowered into place on the upper soil layer 112. The freeze panels typically will have a configuration as shown in FIG. 4 and coolant flowing through the fluid passages of the freeze panels will cause freezing of soil layers 112 and soil layer 114, the frozen soil layers remaining frozen inasmuch as the lower soil layer 114 is in direct contact with the permafrost layer 116.

As an alternate procedure, the freeze panel 110 can be put into place on soil layers 112 and 114 and the coolant directed through the freeze panels while the caisson is being built at a remote location. Then, when soil layers 112 and 114 are frozen after a certain period of time, the caisson can be floated out to the site and then lowered into place on the frozen soil layers. Then, the bottom of the caisson can be frozen to the upper soil layer 112 by having the coolant flow through the uppermost freeze panel 110 while it remains in contact with the upper soil layer 112, causing a mechanical bond to be formed therebetween.

What is claimed is:

1. An island in an arctic climate for placement in a body of water above the permafrost comprising:

an upright body adapted to be placed on the upper surface of a soil layer on the permafrost and to extend upwardly therefrom through the water and to a location above the upper level of the water, said body being of a freezable material, there being a heat exchanger adapted to be placed at and along the interface between the body and the soil layer in laterally extending heat exchange relationship to the body and the soil layer, said heat exchanger including a heat conductive panel having laterally extending fluid passages adapted to receive a flow of coolant therethrough for freezing said body and said soil layer to form a stabilized, monolithic construction.

2. An island as set forth in claim 1, wherein the panel is placed in contact with the body and adapted to be placed on the soil layer, said body including a layer of freezable material above the panel, said panel having a first fluid passage and a second fluid passage for flow of a coolant in heat exchange relationship to the soil layer and the layer of freezable material, respectively.

3. An island as set forth in claim 2, wherein the freezable material is gravel fill material.

4. An island as set forth in claim 2, wherein said material is silty sand material.

5. An island as set forth in claim 1, wherein is included a number of vertically spaced heat laterally extending panels in the body, there being a layer of freezable material above each panel, respectively.

6. An island as set forth in claim 5, wherein the freezable material is selected from the group including gravel and sand.

7. An island as set forth in claim 5, wherein the body has a pair of opposed sides and a pair of opposed ends interconnecting the sides, each side and each end having a plurality of vertically spaced fluid flow devices, respectively, there being a layer of freezable material above each fluid flow device, respectively, the fluid flow devices having fluid passages for a coolant flowable in heat exchange relationship to the adjacent layers of freezable material.

8. An island as set forth in claim 7, wherein the body is in surrounding relationship to a central space, there being a number of vertically spaced fluid flow devices in said central space and a layer of freezable material above each fluid flow device, respectively, in the central space, the upper freezable layer in the central space having an upper surface generally co-extensive with the top of the body.

9. An island as set forth in claim 5, each panel being generally horizontal.

10. An island as set forth in claim 5, each panel being inclined, there being a porous pipe adjacent to the lower end of each panel, respectively, and means coupled with the pipes for pumping fluid received therein to a location exteriorly of the body.

11. An island as set forth in claim 1, including a plurality of vertically spaced heat exchanger panels, there being a layer of freezable material between and in heat exchange relationship to the adjacent panels, and a caisson above the uppermost panel.

12. An island in an arctic climate for a body of water containing a layer of soil above a permafrost line comprising:

an upright island body having a generally continuous outer bank and surrounding an interior space, said body adapted to be placed on the soil layer and to extend upwardly therefrom through the water to a location above the upper level of the water, said body having a number of vertically spaced heat exchanger panels the lower panel being on and in heat exchange relationship to the soil layer, there being a layer of freezable material above and in heat exchange relationship to each panel, respectively, said panels having means for directing a coolant therethrough for freezing the soil layer and said freezable layers to interconnect the body to the soil layer and to present a monolithic construction for the body when the freezable layers are frozen.

13. An island as set forth in claim 12, each panel being of heat conductive material and provided with a fluid passage adjacent thereto for flow of said coolant.

14. An island as set forth in claim 12, wherein the freezable material is selected from the group including gravel and sand.

15. An island as set forth in claim 12, wherein the interior space of the island body is provided with a number of vertically spaced heat exchanger panels, there being a layer of freezable material above each panel, respectively, in the interior space, the upper level of the upper freezable layer being generally co-extensive with the top of the island body.

16. An island as set forth in claim 15, wherein the freezable material is silty sand material.

17. An island as set forth in claim 15, each panel having means therein for directing a coolant in heat exchange to the adjacent freezable layer.

18. An island as set forth in claim 12, wherein the panels are generally horizontal.

19. An island as set forth in claim 12, wherein each fluid flow device comprises a panel, the panels being inclined with the lower margin of each panel being adjacent to the central portion of the body, there being means for collecting fluid adjacent to the lower margins of each panel, respectively, and means coupled with the receiving means for directing such fluid received thereby to a location exteriorly of the body to thereby prevent relatively highly concentrated saline fluids from concentrating in certain locations of the body to thereby assure substantially uniform freezing of the freezable layers.

20. An island in an arctic climate for a body of water containing a layer of soil above a permafrost line comprising:

an upright island body adapted to be placed on the soil layer and to extend upwardly therefrom through the water to a location above the upper level of the water, said body including a caisson and a layer of freezable material below the caisson, said layer of freezable material adapted to be placed on and to form an interface with the soil layer, there being panel means at and extending along said interface for freezing the soil layer and said layer of freezable material.

21. An island as set forth in claim 20, wherein said panel means includes a panel having heat conductive plates spaced from the bottom of the caisson and a layer of insulating material between the plates, there being means defining a fluid flow passage adjacent to and in heat exchange relationship with each plate.

22. An island as set forth in claim 21, wherein is included a plurality of vertically spaced heat exchanger panels below the caisson, the bottom panel adapted to be placed on the upper surface of the soil layer, the upper panel being coupled with the bottom of the caisson, there being a layer of freezable material between each pair of panels, respectively.

23. An island as set forth in claim 22, wherein each layer of freezable material is fill material dredged out of the soil layer before the panels are put into place.

24. A method of making an island in an arctic region in a body of water containing a layer of soil above a permafrost line comprising:

dredging out the soil below said body of water until a soil layer remains above the permafrost line;

placing an island body including a layer of freezable material on the upper surface of the soil layer; and directing a flow of coolant along the interface of and in heat exchange relationship to the soil layer and the freezable layer to freeze the soil layer and the freezable layer to form a stabilized, monolithic construction.

25. A method as set forth in claim 24, wherein said freezing step includes moving a coolant in heat exchange relationship to the freezable layer of the island body and the soil layer.

26. A method as set forth in claim 24, wherein said step of placing the island body includes applying a number of vertically stacked layers of freezable material above said soil layer, and freezing said freezable layers.

27. A method as set forth in claim 26, wherein said step of freezing the freezable layers includes moving a coolant in heat exchange relationship with the layers of freezable material.

28. A method as set forth in claim 27, wherein the coolant flow between each layer is in a generally horizontal plane.

29. A method as set forth in claim 27, wherein the coolant flow between each pair of freezable layers is in directions to cause a hydraulic gradient for relatively salty water, and including the steps of collecting relatively salty water, and pumping the collected relatively salty water to a collection station.

30. A method as set forth in claim 27, wherein the coolant is a water-glycol mixture.

31. A method as set forth in claim 24, wherein the step of placing the island body includes providing a plurality of layers of freezable material in surrounding relationship to a central recess, and placing a number of layers of freezable material in the recess, said freezing step including freezing the freezable layer in the island body and in the recess.

32. A method as set forth in claim 24, wherein said step of placing the island body in place includes forming a space between the body and the upper surface of the soil layer, filling said space with a freezable fluid, said freezing step including freezing a fluid in said space to mechanically bond the island body to said soil layer.

33. A method as set forth in claim 32, wherein is included the step of sealing the outer periphery of the space as the island body is put into place.

34. A method as set forth in claim 32, wherein said step of placing the island body includes lowering a caisson into a position at which the caisson is supported on and bonded to said fluid frozen in said space.

35. A method as set forth in claim 24, wherein the placing step includes stacking a number of layers of freezable material on the soil layer, and lowering a caisson onto the upper layer of freezable material, and freezing said layers of freezable material.

36. A method as set forth in claim 35, wherein the freezable layers are frozen before the caisson is lowered in place.

37. A method as set forth in claim 35, wherein the freezable layers are frozen after the caisson is lowered into place.

38. An island in an arctic climate for placement in a body of water above the permafrost comprising:

an upright body adapted to be placed above a soil layer on the permafrost and to extend upwardly therefrom through the water and to a location above the upper level of the water, said body including a layer of freezable material, there being a heat exchanger below said layer of freezable material and adapted to be placed in contact with said soil layer above the permafrost, said heat exchanger including a panel of heat conductive material provided with a first fluid passage for flow of a coolant in heat exchange relationship to said soil layer and a second fluid passage for flow of a coolant in heat exchange relationship to said layer of freezable material, said panel including a pair of spaced plates of heat conductive material and a layer of insulating material between the plates, the fluid passages being formed by channel members secured to respective plates, whereby the coolant flow through said passages will cause freezing of said layer of said freezable material and said soil layer to form a stabilized, monolithic construction.

39. An island in an arctic climate for placement in a body of water above the permafrost comprising:

an upright body adapted to be placed above a soil layer on the permafrost and to extend upwardly therefrom through the water and to a location above the upper level of the water, said body being of a freezable material selected from the group including gravel and sand;

a number of vertically spaced heat exchangers in the body, there being a layer of freezable material above each heat exchanger, respectively, the lowest heat exchanger being in heat exchange relationship to said soil layer above the permafrost, each heat exchanger comprising a panel, each panel having a pair of spaced, heat conductive plates, a layer of insulating material between each of said pair of plates of each panel, means coupled with a respective plate adjacent to the layer of insulating material for directing a coolant flow in heat exchange relationship to the plate, and a source of coolant for said coolant flow means, whereby the coolant causes freezing of said body and said soil layer to form a stabilized, monolithic construction.

40. An island as set forth in claim 39, wherein said source of coolant is on the top of the body, there being a fluid flow line from the body to each fluid flow passage of each panel, respectively.

41. An island in an arctic climate for placement in a body of water above the permafrost comprising:

an upright body adapted to be placed above a soil layer on the permafrost and to extend upwardly therefrom through the water and to a location above the upper level of the water, said body being of a freezable material, a number of vertically spaced heat exchangers in the body, there being a layer of freezable material above each heat exchanger, respectively, the lowest heat exchange being in heat exchange relationship to said soil layer above the permafrost, each heat exchanger comprising a panel, each panel having a pair of spaced heat conductive plates and a layer of insulating material bonded to and spanning the distance between the plates, each plate having means defining a fluid flow passage directly adjacent thereto for receiving a flow of coolant in heat exchange relationship to the plate, whereby the coolant flow causes freezing of said body and said soil layer to form a stabilized, monolithic construction.

42. An island as set forth in claim 41, wherein at least one of the panels has a greater number of passages near one portion of the panel than at another portion of the panel so that the panel is effectively tilted as to relatively salty water to allow such salty water to gravitate toward the region adjacent to said other portion.

43. An island in an arctic climate for placement in a body of water above the permafrost comprising:

an upright body adapted to be placed above a soil layer on the permafrost and to extend upwardly therefrom through the water and to a location above the upper level of the water, said body being of a freezable material, there being a heat exchanger between and in heat exchange relationship to the body and said soil layer above the permafrost, said heat exchanger being adapted to receive a flow of coolant therethrough for freezing said body and said soil layer to form a stabilized, monolithic construction, the body having an outer bank, there being a panel on the bank extending along the side of the body, the panel having a fluid flow passage therein for receiving a coolant in heat exchange relationship to the bank.

44. An island as set forth in claim 43, wherein the panel includes a layer of concrete, a heat conductive plate, and a layer of insulating material between the concrete layer and the plate, the plate being provided with said fluid flow passage, the plate being in heat exchange relationship with the bank.

45. An island as set forth in claim 44, wherein the panel extends from the top of the body to the bottom of the body and along the upper surface of the soil layer, there being means for circulating a coolant through the fluid passage of the panel in heat exchange relationship to said plate.

46. An island in an arctic climate for placement in a body of water above the permafrost comprising:

an upright body adapted to be placed above a soil layer on the permafrost and to extend upwardly therefrom through the water and to a location above the upper level of the water, said body being of a freezable material, there being a plurality of vertically spaced heat exchangers in the body and a layer of freezable material between and in heat exchange relationship to the adjacent heat exchangers, each heat exchanger including a heat conductive plate and a layer of insulation material coupled with the plate, there being means defining a fluid flow passage for a coolant flowable in heat exchange relationship to the plate, the lowest heat exchanger being in heat exchange relationship to said soil layer above the permafrost, said coolant flow causing freezing of said body and said soil layer to form a stabilized, monolithic construction; and a caisson having a bottom, said caisson being above the uppermost heat exchanger.

47. An island in an arctic climate for placement in a body of water containing a layer of soil above a permafrost line comprising:

an upright island body having a generally continuous outer bank and surrounding an interior space, said body adapted to be placed on the soil layer and to extend upwardly therefrom through the water to a location above the upper level of the water, said body having a number of vertically spaced heat exchangers, the lowest heat exchanger being on and in heat exchange relationship to the soil layer, there being a layer of freezable material above and in heat exchange relationship to each heat exchanger, respectively, each heat exchanger including a panel formed of a pair of spaced, heat conductive plates and a layer of insulation between said plates, means defining a fluid flow path adjacent to and in heat exchange relationship with each plate, respectively, and means for supplying a coolant to said fluid flow passages, whereby coolant flow through said passage causes freezing of the soil layer and said freezable layers to present a monolithic construction.

48. An island as set forth in claim 47, wherein said coolant source is located on the island body.

49. An island in an arctic climate for placement in a body of water containing a layer of soil above a permafrost line comprising:

an upright island body having a generally continuous outer bank and surrounding an interior space, said body adapted to be placed on the soil layer and to extend upwardly therefrom through the water to a location above the upper level of the water, said body having a number of vertically spaced heat exchangers, the lower heat exchanger being on and in heat exchange relationship to the soil layer, there being a layer of freezable material above and in heat exchange relationship to each heat exchanger, respectively, said heat exchangers having means for directing a coolant therethrough for freezing the soil layer and said freezable layers to present a monolithic island construction for the body when the freezable layers are frozen, at least one portion of the outer bank having a fluid flow means for directing a coolant in heat exchange relationship to the bank.

50. An island as set forth in claim 49, wherein said fluid flow means includes a panel having a first, outer concrete layer, a second, insulating layer adjacent to the concrete layer, and a plate of heat conductive material secured to the insulating layer and in heat exchange relationship to the adjacent bank, said panel having means in heat exchange relationship with the plate for directing a coolant in heat exchange relationship to the plate.

51. An island as set forth in claim 50, wherein is included a source of coolant coupled to the coolant directing means in engagement with the bank.

52. An island as set forth in claim 50, wherein said panel includes a segment extending outwardly of the body and along the upper surface of the soil layer below the level of the water.

53. An island in an arctic climate for placement in a body of water containing a layer of soil above a permafrost line comprising:

an upright island body having a generally continuous outer bank and surrounding an interior space, said body adapted to be placed on the soil layer and to extend upwardly therefrom through the water to a location above the upper level of the water, said body having a number of vertically spaced heat exchangers, the lowest heat exchanger being on and in heat exchange relationship to the soil layer, there being a layer of freezable material above and in heat exchange relationship to each heat exchanger, respectively, the interior space of the island body having a number of vertically spaced heat exchangers, there being a layer of freezable material above each heat exchanger in the interior space, respectively, the upper level of the upper freezable layer being generally coextensive with the top of the island body, each heat exchanger including a panel having a pair of spaced, heat conductive plates and a layer of insulating material between the plates, there being means in the insulating material for directing a coolant in heat exchange relationship to each plate, respectively, whereby the coolant flow causes freezing of the soil layer and said freezable layers to present a monolithic island construction.

54. An island in an arctic climate for a body of water containing a layer of soil above a permafrost line comprising:

an upright island body adapted to be placed on the soil layer and to extend upwardly therefrom through the water to a location above the upper level of the water, said body including a caisson, there being means below the bottom of the caisson for freezing the soil layer therebelow and for interconnecting the caisson and the soil layer, said freezing means including a heat exchanger coupled to the bottom of the caisson and adapted to be spaced above the soil layer to present a fluid-receiving space therebetween, said heat exchanger having means for directing a coolant in heat exchange relationship to a fluid in said space, there being means for sealing the outer periphery of the space to permit a freezable fluid to fill the space and to be in direct contact with the panel thereabove and the soil layer therebelow to bond the panel and soil layer when the freezable fluid is frozen.

55. An island as set forth in claim 54, wherein is included pump means coupled with the space to allow salt water to be pumped out of the space and to allow fresh water to be pumped into the space.

56. An island as set forth in claim 54, wherein said seal means includes an inverted U-shaped channel member adapted to partially penetrate the soil layer.

57. An island in an arctic climate for a body of water containing a layer of soil above a permafrost line comprising:

an upright island body adapted to be placed on the soil layer and to extend upwardly therefrom through the water to a location above the upper level of the water, said body including a caisson, there being a plurality of vertically spaced panels below the caisson, the bottom panel adapted to be placed on the upper surface of the soil layer for freezing the soil layer therebelow, the upper panel being coupled with the bottom of the caisson, there being a layer of freezable material between each pair of panels, respectively, each panel including a pair of spaced heat conductive plates, a layer of insulating material between each pair of plates, respectively, and means coupled with the plates for defining fluid passages in heat exchange relationship to respective plates, there being a source of coolant coupled with the fluid passages for directing the coolant therethrough in heat exchange relationship to the plates.

58. An island in an arctic climate for placement in a body of water above the permafrost comprising:

an upright body adapted to be placed on the upper surface of a soil layer on the permafrost and to extend upwardly therefrom through the water and to a location above the upper level of the water, said body being of a freezable material, there being a heat exchanger adapted to be placed at and along the interface between the body and the soil layer in heat exchange relationship to the body and the soil layer, said heat exchanger including a heat conductive panel having fluid passages adapted to receive a flow of coolant therethrough for freezing said body and said soil layer to form a stabilized, monolithic construction, said panel having means movable into the surface therebelow to present a fluid receiving space to form a seal by a freezing action about the periphery of the space to permit a freezable fluid to fill the space and to be in direct contact with the panel thereabove and to the surface therebelow.

59. An island as set forth in claim 58, wherein is included pump means coupled with said space to allow relatively salty water to be pumped out of the space and allow relatively fresh water to be drawn into the space.

60. An island as set forth in claim 58, wherein said seal means includes an inverted U-shaped channel member adapted to partially penetrate the surface therebelow to permit it to form said space.

61. An island in an arctic climate for placement in a body of water above the permafrost comprising:

an upright, floatable caisson adapted to be placed on the upper surface of a soil layer on the permafrost and to extend upwardly therefrom through the water and to a location above the upper level of the water, said caisson being of a freezable material, there being a heat exchanger adapted to be placed at and along the interface between the caisson and the soil layer in heat exchange relationship to the caisson and the soil layer, said heat exchanger including a heat conductive panel at the bottom of said caisson and having fluid passages adapted to receive a flow of coolant therethrough for freezing said caisson and said soil layer to form a stabilized, monolithic construction, said panel having means movable into the surface therebelow to present a fluid receiving space to form a seal by a freezing action about the periphery of the space to permit a freezable fluid to fill the space and to be in direct contact with the panel thereabove and to the surface therebelow.

62. An island as set forth in claim 61, wherein the material of the caisson is selected from the group including steel and concrete.

63. An island as set forth in claim 61, wherein the caisson has means for allowing a change in the buoyancy of the caisson.

* * * * *